US008999071B2

(12) United States Patent
Tulchinsky et al.

(10) Patent No.: US 8,999,071 B2
(45) Date of Patent: Apr. 7, 2015

(54) SURFACTANTS DERIVED FROM OLIGOGLYCEROLS

(75) Inventors: Michael L. Tulchinsky, Midland, MI (US); Wanglin Yu, Pearland, TX (US); Sze S. Ng, Midland, MI (US); Cynthia L. Rand, Sanford, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 14/345,347

(22) PCT Filed: Sep. 11, 2012

(86) PCT No.: PCT/US2012/054639

§ 371 (c)(1), (2), (4) Date: Mar. 17, 2014

(87) PCT Pub. No.: WO2013/062679

PCT Pub. Date: May 2, 2013

(65) Prior Publication Data

US 2015/0005225 A1 Jan. 1, 2015

Related U.S. Application Data

(60) Provisional application No. 61/551,680, filed on Oct. 26, 2011.

(51) Int. Cl.

| | |
|---|---|
| ***C11D 3/20*** | (2006.01) |
| ***C11D 3/26*** | (2006.01) |
| ***C11D 7/26*** | (2006.01) |
| ***B08B 3/04*** | (2006.01) |
| ***C11D 1/72*** | (2006.01) |
| ***C11D 7/06*** | (2006.01) |
| ***C11D 7/32*** | (2006.01) |

(52) U.S. Cl.
CPC *C11D 7/263* (2013.01); *C11D 1/72* (2013.01); *C11D 7/06* (2013.01); *C11D 7/3218* (2013.01)

(58) Field of Classification Search
CPC ..... C11D 3/20; C11D 3/2048; C11D 7/26; C11D 3/044; C11D 3/2068; C11D 3/26; B08B 3/04
USPC ..... 510/505, 506; 134/25.2, 25.3, 39, 42
See application file for complete search history.

(56) References Cited

U.S. PATENT DOCUMENTS

| | | | | |
|---|---|---|---|---|
| 4,430,237 | A * | 2/1984 | Pierce et al. | 510/422 |
| 2011/0207969 | A1 | 8/2011 | Olken et al. | |
| 2012/0184476 | A1 * | 7/2012 | Sakanishi | 510/136 |

FOREIGN PATENT DOCUMENTS

| | | | | |
|---|---|---|---|---|
| EP | 2096160 | | 9/2009 | |
| WO | WO 2011/040254 | * | 4/2011 | A61K 8/33 |

* cited by examiner

*Primary Examiner* — Brian P Mruk

(57) ABSTRACT

Provided is a surfactant composition comprising an oligoglycerol compound of formula I, wherein R and m are as defined above. The compounds exhibit favorable surfactancy properties. Advantageously, the compounds may be prepared from renewable materials.

(I)

2 Claims, 2 Drawing Sheets

Compound 3 Surface Tension vs. Concentration

Dynamic Surface Tension

SURFACTANTS DERIVED FROM OLIGOGLYCEROLS

CROSS-REFERENCE TO RELATED APPLICATIONS

This application claims priority from provisional application Ser. No. 61/551,680, filed Oct. 26, 2011, which is incorporated herein by reference in its entirety.

BACKGROUND

This invention relates generally to surfactant compositions and more specifically to surfactant compositions that are derived from oligoglycerol.

Surfactants are important materials that find use across a broad spectrum of applications. A wide variety of surfactant types are known. One class is the nonionic surfactants, which are used in many commercial and household applications where advantage is taken of their superior performance as wetting agents, their detergency and scouring characteristics and resistance to hard water conditions, as well as their adaptability for being combined with other types of surfactants.

Many common nonionic surfactants are prepared by the addition of ethylene oxide or mixtures of ethylene oxide and propylene oxide to various alcohols, which are generally long-chain monohydric alcohols. Numerous different adducts have been prepared, some of which contain only oxyethylene groups while others contain a random distribution of oxyethylene and oxypropylene groups or discrete blocks of polyoxyethylene and polyoxypropylene.

In recent years, there has been a trend towards surfactants based on naturally-occurring materials, with the goal that such surfactants would exhibit favorable environmental properties, such as ready biodegradation, and would be available from renewable sources.

Carbohydrate-based materials, such as alkyl glycosides and alkyl polyglycosides (APGs), which are derived from sugar, have been attractive materials for meeting the foregoing goals. However, the widespread use of APGs has been hampered because their surfactancy properties are often not as favorable as those of their alkylene oxide/alcohol derived counterparts. For instance, many APGs are too high-foaming, unstable in acidic environments, exhibit poor miscibility, have poor wetting on hydrophobic surface, and/or have poor cleaning power, also they are unable to provide good dynamic surface tension reduction which is important for many applications, such as paints and coatings, adhesives, inks, and hard surface cleaning in which new surface/interface formation occurs rapidly.

The problem addressed by this invention is the provision of nonionic surfactants that may be prepared from naturally occurring materials, and that also exhibit favorable surfactancy properties, in particular excellent dynamic surface tension reduction property

STATEMENT OF INVENTION

We have now found that oligoglycerol compounds described below exhibit desirable properties, including the ability to provide low surface tension at very low concentrations and to do so in a short time frame. Compounds of the invention are also effective hard surface cleaners. Advantageously, the compounds may be prepared from renewable sources.

In one aspect, there is provided a composition comprising an oligoglycerol compound of formula I:

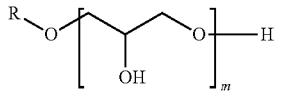

(I)

wherein R is linear or branched $C_9$-$C_{11}$ alkyl; m is 2 or 3, and wherein a 0.1% solution of the oligoglycerol compound in de-ionized water has a surface tension of 31 dynes/cm or less and reaches a dynamic surface tension of 40 dynes/cm or less at 6 bubbles/sec or more preferably 10 bubbles/sec as measured by the maximum bubble pressure method, provided that the compound of formula I is not: 3-(3-(decyloxy)-2-hydroxypropoxy)propane-1,2-diol; or 3-(2-hydroxy-3-(undecyloxy)propoxy)propane-1,2-diol.

In another aspect, there is provided a method of cleaning a hard surface, the method comprising contacting the surface with a cleaning composition comprising a compound of formula II:

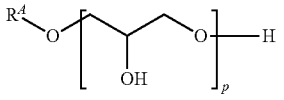

(II)

wherein $R^A$ is linear or branched $C_9$-$C_{11}$ alkyl; and p is 2 or 3.

In a further aspect, there is provided an aqueous hard surface cleaning formulation comprising a compound of formula I or II, together with an alkaline agent, a glycol ether, and an alkanolamine.

DETAILED DESCRIPTION

Figure 1:
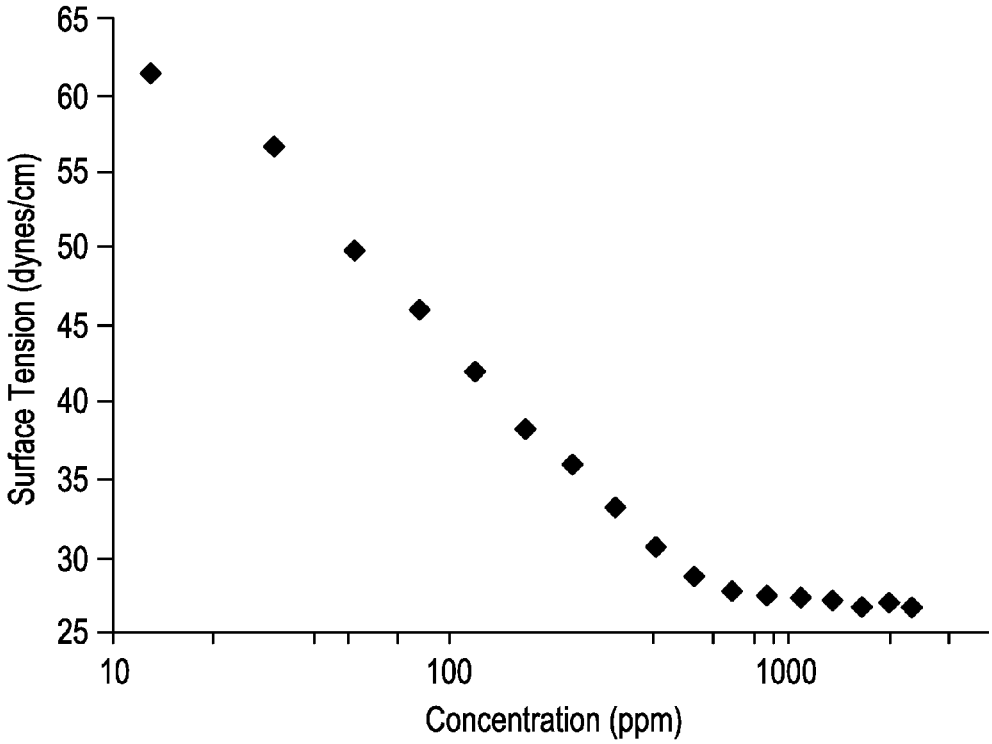
FIG. 1 is a plot of surface tension versus concentration plot for compound 3 (from example 3) at 25° C.

The present inventors have discovered that oligoglycerol compounds containing the specific glycerol and alkyl structures as described herein function as nonionic surfactants with significantly better dynamic surface tension reduction property than other oligoglycerol compounds and as well as surfactants based on polyoxyethylene or polyglucoside. The inventive compositions meet desired surface active properties, for instance providing surface tension of 31 dynes/cm or less at a concentration of 0.1 weight percent in deionized water, and at the same time, achieving dynamic surface of 40 dynes/cm or less at 6 bubbles/sec as measured by the maximum bubble pressure method. Moreover, compositions of the invention exhibit desirable surface cleaning properties.

The surface tension and critical micelle concentration (cmc) of a surfactant solution is measured using Kruss K100 Surface Tensiometer fitted with a Wilhelmy platinum plate. A standard method is utilized. In this method, an increment of surfactant solution is added using a Dosimat™ dosimeter to the vessel initially containing deionized water, and then thoroughly stirred. The surface tension of the resulting solution is then measured. The process is repeated at each concentration data point. Two measurements are made for each system at ambient temperature. The conditions of the measurement are summarized in Table 1.

TABLE 1

Standard surface tension and CMC method measurement parameters utilized in this study.

| Parameter | Value |
|---|---|
| Cup diameter | 6.65 cm |
| Cup height | 3.75 cm |
| Method | 12 (P/SFT) |
| Measuring interval | 15 sec |
| Maximum number of values | 3 |
| Minimum standard deviation | 0.5 mN/m |
| Linear factor of dosing | 0.1 |
| Exponent | 0.12 |
| Values for mean | 5 |
| Preset volume | volume of surfactant solution in a vessel, usually 45-50 mL |
| Concentration scaling | Logarithmic |
| Number of series | 18 |

In some embodiments, a 0.1% solution of the compound of formula I in de-ionized water has a surface tension of 30 dynes/cm or less, alternatively 28 dynes/com or less.

Dynamic surface tension is measured using a Kruss BP-2 Bubble Pressure Tensiometer. During the test, high purity nitrogen gas bubbles are produced in the surfactant solution at an exactly defined bubble generation rate. The gas bubbles enter the liquid through a glass capillary of known radius (0.223 mm). During this process the pressure passes through a maximum whose value is recorded by the instrument. Surface tension is then calculated from the maximum pressure during bubble formation, and reported as a function of bubble surface age, in ms, and bubble frequency. The measurements are made at ambient temperature.

In some embodiments, compounds of formula I reach a dynamic surface tension of 35 dynes/cm or less at 6 bubbles/sec, alternatively 10 bubbles/sec, at a solution concentration of 0.1 wt %. In some embodiments, they reach 38 dynes/cm or less at 10 bubbles at the solution concentration of 0.1 wt %. In some embodiments, they reach 40 dynes/cm or less at 6 bubbles at a solution concentration of 0.05 wt %.

In some embodiments of the invention, the oligoglycerol compound of formula I is of the formula I-A:

(I-A)

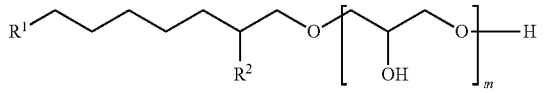

wherein m is 2 or 3; and $R^1$ and $R^2$ are independently H or linear or branched $C_1$-$C_4$ alkyl, provided that $R^1$ and $R^2$ together contain from 2 to 4 carbon atoms.

In some embodiments of formula I-A, $R^1$ is H and $R^2$ is n-propyl.

In some embodiments, $R^1$ is ethyl and $R^2$ is H.

In some embodiments of formula I or I-A, m is 2.

In some embodiments of formula I-A, $R^1$ is propyl and $R^2$ is H, and m is 3.

Preferred compounds of formula I include: 3-[3-(nonyloxy)-2-hydroxypropoxy]-1,2-propanediol; 3-(2-hydroxy-3-((2-propylheptyl)oxy)propoxy)propane-1,2-diol; or 3-(3-(3-(decyloxy)-2-hydroxypropoxy)-2-hydroxypropoxy) propane-1,2-diol. Particularly preferred is 3-(2-hydroxy-3-((2-propylheptyl)oxy)propoxy)propane-1,2-diol.

In some embodiments, the compound of formula I is 3-(3-((3,7-dimethyloctyl)oxy)-2-hydroxypropoxy)propane-1,2-diol.

The compounds of the invention may be prepared in one step from the corresponding carbonyl compound (e.g., aldehyde) and diglycerol or triglycerol in the presence of hydrogen and a hydrogenation catalyst. In some embodiments, the molar ratio of diglycerol or triglycerol to carbonyl compound may be greater than 5:1, thus providing a large excess of the oligoglycerol. A solvent may be used, such as ether, dioxane, or THF. However, since excess diglycerol/triglycerol itself functions as a solvent, additional solvent is not needed and is generally not preferred.

Suitable hydrogenation catalysts are well known in the art and include, by way of example, those that are based on Pd, Pt, Rh, or Ru as well as transition metals such as Ni, Co, Cu, and Fe. The catalyst loading (at 100% active) in the process preferably ranges from 0.001 to 3 weight percent, preferably from 0.01 to 1 weight percent, and more preferably from 0.3 to 0.8 weight percent, based on the weight of carbonyl compound. The catalyst may be present in a carrier such as carbon, alumina, silica gel or zeolites. A preferred catalyst/carrier is 5% Pd/C (pH of about 5), which is available from commercial sources or can be made according to U.S. 2011/0207969 A1 (Aug. 25, 2011).

The reaction may be carried out at a temperature of between 30 and 300° C., preferably at elevated temperature, such as between 100 and 250° C., more preferably between 150 and 220° C. Reaction pressure ranges from 0 to about 3000 psi. Elevated pressure is preferred, such as between 200 and 2000 psi and more preferably between 500 and 1500 psi. In some embodiments, a lower pressure may be preferred, such as 200 to 300 psi.

Generally, the reaction is run from between a few minutes to about 24 hours, with 1 to 8 hours being preferred. The product(s) may be isolated from the reaction mixture by techniques well known to those skilled in the art, such as solvent extraction, distillation, and/or chromatography. For products that phase separate decantation may be used.

One of the advantages of the inventive compounds is that that they may be prepared from renewable materials. For instance, carbonyl components used in the synthesis can be nature-derived, such as nonanal derived from soybean oil via ozonolysis. Similarly, glycerol based components may be derived from biodiesel. Thus, a whole molecule may be prepared entirely from renewable sources.

The compounds and compositions of the invention are useful in a wide variety of formulations and applications where the presence of surfactants is desired or needed. By way of non-limiting example, the surfactants may be used as or in: hard surface cleaners, laundry detergents, paint and coatings formulations, emulsion polymerization agents or formulations, household and industrial cleaners, agricultural formulations, latex formulations, environmental remediation agents, oilfield chemicals, enhanced oil recovery formulations, gas treating formulations, textile processing and finishing agents, pulp and paper processing agents, fragrance solubilization agents formulations, metal working fluids such as cutting fluids, personal care products (including skin and hair care products such as shampoos), and the like.

In one aspect, the compositions as described herein are useful in a method of cleaning a hard surface. According to this aspect of the invention, the method comprises contacting the surface with a cleaning composition comprising a compound of formula II:

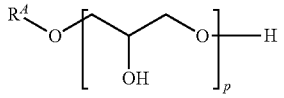

(II)

wherein $R^A$ is linear or branched $C_9$-$C_{11}$ alkyl; and p is 2 or 3.It should be noted that the compounds 3-(3-(decyloxy)-2-hydroxypropoxy)propane-1,2-diol; and 3-(2-hydroxy-3-(undecyloxy)propoxy)propane-1,2-diol are not excluded from this aspect of the invention.

In some embodiments of formula II, p is 2.

Preferred compounds of formula II include: 3-[3-(nonyloxy)-2-hydroxypropoxy]-1,2-propanediol; 3-(2-hydroxy-3-((2-propylheptyl)oxy)propoxy)propane-1,2-diol; 3-[3-(decyloxy)-2-hydroxypropoxy]-1,2-propanediol; 3-(3-((3,7-dimethyloctyl)oxy)-2-hydroxypropoxy)propane-1,2-diol; and 3-(2-hydroxy-3-(undecyloxy)propoxy)propane-1,2-diol.

The amount and formulation of the surfactants of the invention to be used in the various applications described herein varies depending on the application and the desired result and can be determined by a person of ordinary skill in the art without undue experimentation. By way of non-limiting example, a formulation that includes therein surfactants of the invention may contain at least about 0.01 weight percent of the surfactant, based on the total weight of the formulation.

Compositions of the invention may include additives such as, but not limited to, one or more of fragrances, alkaline agents such as sodium hydroxide, sodium bicarbonate, silicates, chelants, amines, antioxidants, pigments, salts, alkali, and enzymes, water soluble polymers, dispersants, other surfactants, alkanolamines, and solvents such as water or glycol ethers. Such additives may be added to the composition in amounts known to those skilled in the art to be effective for the intended purpose.

In some embodiments where the composition is a hard surface cleaner, preferred additives include alkaline agents (such as sodium hydroxide), glycol ethers (such as dipropylene glycol n-butyl ether, and an alkanolamine (such as monoethanolamine and/or di-isopropanolamine).

Unless otherwise indicated, numeric ranges, for instance as in "from 2 to 10," are inclusive of the numbers defining the range (e.g., 2 and 10).

Unless otherwise indicated, ratios, percentages, parts, and the like are by weight.

Some embodiments of the invention will now be described in detail in the following Examples.

EXAMPLES

Example 1

Preparation of 3-[3-(nonyloxy)-2-hydroxypropoxy]-1,2-propanediol (Compound 1)

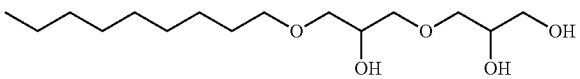

major isomer

Diglycerol from TCI America containing >80% of the α,α-isomer (166.15 g, 1.00 mol) and 5% Pd/C (1.03 g) from Johnson-Matthew are added to a 250 ml Parr reactor and purged three times with hydrogen with stirring. Then nonanal (pelargonaldehyde) from TCI America (20.7 g, 0.145 mol) is introduced by syringe and the mixture purged with hydrogen two more times. Hydrogen (100 psi) is charged, the reactor quickly heated to 200° C. with stirring, and run at 250 psi for 20 h. The reaction mixture is filtered from the catalyst, the reactor washed with methanol (50 ml×2), the solution concentrated and combined with the main portion. The mixture is extracted with toluene (50 mL×10), toluene was removed in vacuum, and light fractions are distilled off from the crude product at 100-200° C. and 0.04 mm Hg. The residue is chromatographed on silica gel using hexane-ethyl acetate from 3:1 to 1:2.The collected fractions are analyzed by GC and TLC. Fractions 35-55 are combined, solvent evaporated to give 13.39 g of the product as a mixture of isomers. $^1$H NMR (δ, $CDCl_3$, ppm): 0.89 t (3 H, $CH_3$), 1.28 (12 H, $(CH_2)_6$), 1.57 t (2 H, $CH_2$), 3.4-4.0 m (15 H, diglycerol moiety+$CH_2O$+OH groups). $^{13}$C NMR (δ, $CDCl_3$, ppm): 14.43, 22.99, 26.39, 29.59, 29.81, 29.88, 32.20, 64.08 (alkyl), 69.75, 69.84, 71.13, 71.25, 72.01, 72.04, 73.15, 73.25, 73.31, 73.41 (diglycerol, two diastereomers). GC/MS: 293 (M+1), 275, 201, 183, 167, 149.

Example 2

3-(3-(3-(decyloxy)-2-hydroxypropoxy)-2-hydroxypropoxy)propane-1,2-diol (Compound 2)

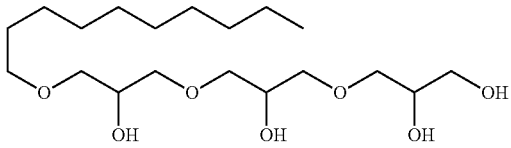

major isomer

The procedure of Example 1 is repeated, except 168.2 g (0.70 mol) of triglycerol from Solvay is used in place of diglycerol, 21.88 g (0.14 mol) of decanal is used in place of nonanal, and 1.1 g of 5% Pd/C is used in place of 1.03 g of 5% Pd/C. After the reaction completion, the product is extracted with diethyl ether (30 mL×7). The solvent is evaporated and a half of the crude product is chromatographed on silica gel using straight ethyl acetate. Appropriate fractions are combined, solvent evaporated to give 8.01 g of the product as a mixture of isomers. $^1$H NMR (δ, $CDCl_3$, ppm): 0.88 t (3 H, $CH_3$), 1.26 (14 H, $(CH_2)_7$), 1.58 t (2 H, $CH_2$), 3.4-4.2 m (21 H, triglycerol moiety+$CH_2O$+OH groups). $^{13}$C NMR (δ, $CDCl_3$, ppm): 14.44, 23.02, 26.41, 29.64, 29.80, 29.90, 29.93, 32.20, 29.96, 64.15 (decyl), 69.82, 69.88, 71.04, 71.13, 71.99, 72.01, 72.03, 72.06, 73.24, 73.28, 73.32, 73.36 (triglycerol). GS/MS with TMS derivatization: 668 (MW+four TMS groups).

Example 3

3-(2-hydroxy-3-((2-propylheptyl)oxy)propoxy)propane-1,2-diol (Compound 3)

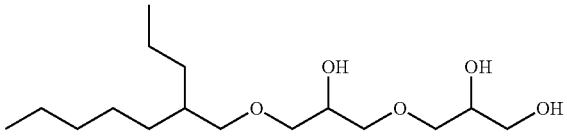

major isomer

Diglycerin from Solvay (166.15 g, 1.00 mol) and 5% Pd/C (1.23 g) from Johnson-Matthew are added to a 250 ml Parr reactor and purged three times with hydrogen with stirring. Then 2-propylhept-2-enal, obtained by condensation of valeraldehyde, (24.68 g, 0.16 mol) is introduced by syringe and the mixture is purged with hydrogen two more times. Hydrogen (200 psi) is charged, the reactor was quickly heated to 200° C. with stirring, and run at 500 psi for 20 h. The reaction mixture is filtered from the catalyst, the reactor washed with methanol (50 ml×2), the solution is concentrated and combined with the main portion. The upper phase containing the crude product (25.9 g) is separated. The diglycerol (lower) phase is extracted with toluene (100 mL×8) and then toluene is removed in vacuum to give additionally 11.5 g of the extracted product, which is chromatographed on silica gel using hexane-ethyl acetate from 1:2 to 1:4.The collected fractions are analyzed by GC and TLC. Fractions 8-27 are combined and give 10.86 g of the product as a mixture of isomers. $^{1}$H NMR (δNMR ($CDCl_3$, ppm): 0.86 m (6 H, two $CH_3$), 1.26 (12 H, six $CH_2$), 1.55 m (H, CH), 3.3-4.2 m (15 H, diglycerol moiety+$CH_2O$+OH groups). $^{13}$C NMR (δNMR ($CDCl_3$, ppm): 14.43, 22.99, 26.39, 29.59, 29.81, 29.88, 32.20, 64.08 (alkyl), 69.75, 69.84, 71.13, 71.25, 72.01, 72.04, 73.15, 73.25, 73.31, 73.41 (diglycerol, two diastereomers). GC/MS: 293 (M+1), 275, 201, 183, 167, 149.

Example 4

3[3-(decyloxy)-2-hydroxypropoxy]-1,2-propanediol (Compound 4)

The procedure of Example 1 is repeated, except 31.25 g (0.2 mol) of decanal is used as the aldehyde and 1.56 g of 5% Pd/C is used for the catalyst. After the reaction completion, the system forms two phases. The upper phase is separated and combined with the toluene extracts of the lower phase (50 ml×3) after toluene evaporation. The crude product is chromatographed on silica gel using hexane-ethyl acetate from 4:1 to 1:1. Appropriate fractions are combined, solvent evaporated to give 11.3 g of the product as a mixture of isomers. $^{1}$H NMR (δ, $CDCl_3$, ppm): 0.85 t (3 H, $CH_3$), 1.24 (14 H, $(CH_2)_7$), 1.53 t (2 H, $CH_2$), 3.4-3.9 m (15 H, diglycerol moiety+$CH_2O$+OH groups). $^{13}$C NMR (δ, $CDCl_3$, ppm): 14.44, 23.00, 26.38, 29.64, 29.82, 29.87, 29.90, 29.94, 32.21, 63.92 and 63.96 (alkyl), 69.61, 69.71, 71.16, 71.29, 72.01, 72.96, 73.07, 73.34, 73.45 (diglycerol diastereomers). GC/MS: 207 (M+1), 117, 81.

Example 5

3-(3((3,7-dimethyloctyl)oxy)-2-hydroxypropoxy)propane-1,2-diol (Compound 5)

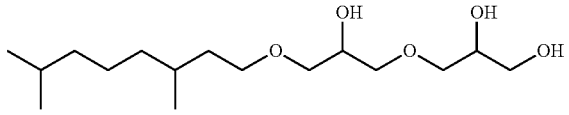

The procedure of Example 1 is followed, except _24.36 g (0.16 mol) of citral is used as the aldehyde and 1.22 g of 5% Pd/C as the catalyst. $^{1}$H NMR (δ, $CDCl_3$, ppm): 0.82-0.86 m (9 H, three $CH_3$ groups), 1.11 m (2 H, $CH_2$), 1.23 m (2 H, $CH_2$), 1.34 m (1H, CH), 1.49 (2H, $CH_2$), 1.57 m (1H, CH), 3.4-3.9 m (15 H, diglycerol moiety+$CH_2O$+OH groups). $^{13}$C NMR (δ, $CDCl_3$, ppm): 19.59 and 19.61, 22.53 and 22.63, 24.59, 27.88, 29.86, 36.53, 37.31 and 37.33, 39.22 (alkyl group), 63.61, 63.64, 69.34, 69.43, 70.03, 70.75, 71.66, 71.72, 72.71, 72.81, 72.98, 73.09 (diglycerol diastereomers). GC/MS: 307 (M+1), 289, 215, 167.

Example 6

3-(2-hydroxy-3-(undecyloxy)propoxy)propane-1,2-diol (Compound 6)

The procedure of Example 1 is followed, except 37.8 g of undecanal with 72% purity is used as the aldehyde and 1.89 g of 5% Pd/C as the catalyst. $^{1}$H NMR (δ, $CDCl_3$, ppm): 0.85 t (3 H, $CH_3$), 1.23 (16 H, $(CH_2)_8$), 1.53 t (2 H, $CH_2$), 3.4-4.3 m (15 H, diglycerol moiety+$CH_2O$+OH groups). $^{13}$C NMR (δ, $CDCl_3$, ppm): 14.03, 22.62, 26.01, 29.28, 29.41, 29.44, 29.52, 29.57, 31.85, 63.74 and 63.76 (alkyl), 69.42, 69.51, 70.82, 70.94, 71.74, 72.82, 72.92, 73.00, 73.11 (diglycerol diastereomers). GC/MS: 321 (M+1), 303, 229, 167.

Example 7

Compound Properties

Surface Tension Properties

Surface tension-Concentration data for the compound 3 at 25° C. are plotted in FIG. 1. As seen, compound 3 can reduce water surface tension to 26-27 dynes/cm after reaching critical micelle concentration (cmc) and the cmc of the compound is about 700 ppm.

Dynamic Surface Tension Versus Surface Age Time

Figure 2:
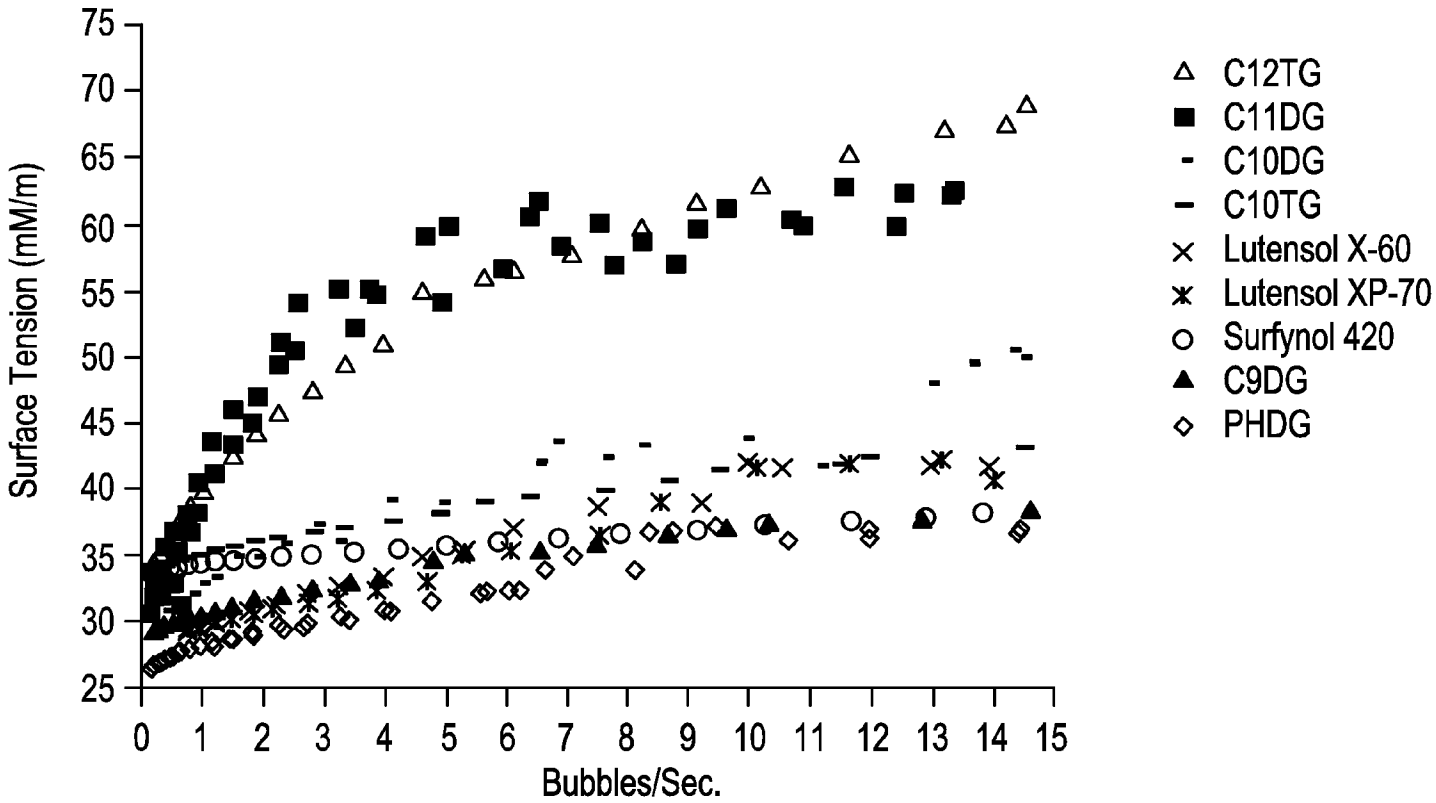
FIG. 2 is a plot of surface tension of various inventive and comparative compositions at varying surface age time.

Dynamic surface tension of surfactants at varying surface ages (presented as bubble frequency) are measure by bubble pressure method on Kruss BP2 tensiometer at 0.1 wt % concentration and 25° C. Comparisons between inventive and non-inventive compounds are shown in FIG. 2. The tested compounds are as follows:

C9DG (inventive) is compound 1.

C10TG (inventive) is compound 2.

PHDG (inventive) is compound 3.

C12TG (comparative compound) is 3-(3-(3-(dodecyloxy)-2-hydroxypropoxy)-2-hydroxypropoxy)propane-1,2-diol.

C11DG is 3-(2-hydroxy-3-(undecyloxy)propoxy)propane-1,2-diol.

C10DG is 3-(3-(decyloxy)-2-hydroxypropoxy)propane-1,2-diol

Lutensol® X-60 (comparative) is a 2-propylheptanol ethoxylate based surfactant available from BASF.

Lutensol® XP-70 (comparative) is a 2-propylheptanol ethoxylate based surfactant available from BASF.

Surfynol® 420 (comparative) is an acetylenic diol based Gemini surfactants based surfactant available from Air Products.

As seen can be seen from FIG. 2, inventive compounds 1, 2, and 3 provide lower surface tension over the whole tested range of ageing time when compared to the structurally similar but non-inventive (i.e., comparative) compounds C12TG, C11DG, and C10DG. Moreover, the inventive compounds provide results that are comparable or better to those of the tested commercial surfactants.

In particular, compound 3 (PHDG) exhibits lower surface tension in the whole range of surface ageing time, especially at high bubble frequency, compared to the Lutensol products. When the bubble frequency is larger than 10 bubbles/sec, compound 3 still maintains surface tension around 37 dynes/cm, while the surface tension from Lutensol® XP-60 and -70 is about 42 dynes/cm.

Surfynol® 420 is acetylenic diol based Gemini surfactant from Air Products and is well known as super wetting agents with excellent dynamic surface tension property. Indeed as seen in FIG. 2, Surfynol® 420 shows very small change in surface tension with the increase of bubble frequency. At >10 bubbles/sec. bubble frequency, their surface tensions are still below 40 dynes/cm. Compound 3 (PHDG) well matches the surface tension change profile of Surfynol® 420 at high bubble frequency (>8 bubbles/sec.), and compound 3 can provide significantly lower surface tension at lower bubble frequency (1-6 bubbles/sec.).

The surface tension data of inventive compound 3, versus Lutensol XP-60 and XP-70 and other comparative compounds at 6 bubbles/sec. at both 0.1 wt % and 0.05 wt % concentrations are summarized in Table 2.At lower concentration, the difference of surface tension between compound 3 and the Lutensol® products is even larger.

TABLE 2

| Surface Tension (dyne/cm) @ 6 bubbles/sec. | | |
|---|---|---|
| | 0.1 wt % | 0.05 wt % |
| C9DG | 35.6 | |
| C10DG | 43.8 | |
| C10TG | 39.0 | |
| PHDG | 33.3 | 39.4 |
| C11DG | 61.4 | |
| C12TG | 56.9 | |
| Lutensol XP-60 | 37.3 | 47.3 |
| Lutensol XP-70 | 35.6 | 48.2 |
| Surfynol 420 | 36.4 | |

Foaming and Wetting Properties

Shake foam property of compounds 1 and 2 are tested and compared with Triton™ CG-110, a commercial surfactant from The Dow Chemical Company: 10 ml of surfactant solution in deionized water at 0.1 wt % is placed in a 100 ml wide-mouth bottle with cap. All the test solutions in bottles are secured on the plate of an orbital shaker and are shaken at for 10 minutes. After the shaking, the foam volume in each bottle is recorded at different times. The results are summarized in Table 3.As seen, the samples from Examples 1 and 2 showed higher foaming than Triton™ CG-110.

TABLE 3

| Shake Foam Property of Samples Shaken Foam Volume | | | |
|---|---|---|---|
| | 0 min. | 20 min. | 60 min. |
| Example 1 | 41 ml | 40 ml | 37 ml |
| Example 2 | 45 ml | 44 ml | 43 ml |
| Triton ™ CG-110 | 34 ml | 31 ml | 30 ml |

Ross-Miles foaming property is tested for compound 2 at 0.1 wt % following the procedure of ASTM D1173 at 25° C. The initial foam height and the foam height at 5 minutes are 155 and 135 mm, respectively, indicating high and stable foam of the sample.

Skein wetting, or Draves wetting time is tested for compound 2 at 0.1 wt % and 25° C. following the procedure of ASTM Method D2281.The wetting time is 5.3 seconds, indicating this surfactant has excellent wetting capability to cotton skeins.

Stability in Caustic and Acidic Solutions

The caustic stability of compounds 1 and 2 is measured by their solubility in 10 wt % NaOH solution: stock solutions are prepared at 1 wt %. Into a sample vial, 1.0 gram of a stock solution is weighed and then 9.0 grams of 11.1 wt % NaOH solution is added to get a 0.1 wt % surfactant solution in 10% NaOH. Both solutions are clear at this condition. In contrast, Tomadol® 91-6 (C9-C11 alcohols ethoxylated to 6EO, cloud point=52° C.) solution (0.1 wt %) becomes cloudy at 5% NaOH content. The results indicate the surfactant samples from this invention are more stable in caustic solution compared to fatty alcohol ethoxylates.

The acidic stability of compounds 1 and 2 are tested and compared with Triton™ CG-110 in 0.01 M HCl: solutions are prepared in 0.01 M HCl at 0.1 wt % surfactant concentration. Compound 1 solution is cloudy at this HCl concentration, indicating its cloud point is reduced by the presence of HCl. The shake foaming property of the surfactant solutions in 0.01 M HCl is measured right after the preparation of the solution and after 20 hours in air at room temperature and the results are summarized in Table 4.The results indicate improved stability with compounds 1 and 2.

TABLE 4

| Foam Volume (ml) (0.1 wt %, in 0.01M HCl, 10 ml solution, shaken at "high" for 10 min.) | | | |
|---|---|---|---|
| Time | Compound 1 | Compound 2 | Triton ™ CG-110 |
| 0 h | 17 ml (no change in 30 minutes) | 20 ml (No change in 30 minutes) | 15 ml (Foam collapsed in 5 minutes) |
| 20 h | 17 ml (no change in 30 minutes) | 20 ml (No change in 30 minutes) | Almost no foam |

Example 8

Hard Surface Cleaning Properties

The efficiency for alkyl oligoglycerols to remove carbon black soil on a hard surface is evaluated by a scrubbing test. A vinyl tile is soiled by spreading 500 uL of a carbon black soil (61.06% naphtha, 27.62% caprylic/capric triglyceride, 8.15% soybean oil, and 3.17% carbon black) uniformly using a foam brush. The tile is air-dried in a fume hood over the weekend. The soiled tile is divided into 12 wells. Surfactant formulations (600 uL 1% surfactant (examples 1-8), 3% DOWANOL™ PnB (a glycol ether containing propylene glycol n-butyl ether), 0.5% monoethanolamine in water are each added into individual wells. The soiled vinyl tile is scrubbed for 5 min with paper towel scrubbers. After scrubbing, cleaning solutions are removed and the wells are rinsed gently with DI water. The vinyl tile is dried overnight. The image of the vinyl tile is recorded with a scanner, and analyzed by imaging software ImageJ to determine the grey scale in each well. Each surfactant formulation is tested three times, except compound 4 which is tested two times. The grey scale values after the hard surface cleaning tests are summarized in Table 5. Average grey values are reported.

TABLE 5

Hard Surface Cleaning Results of Samples

| Compound No. | Average Grey Scale Value |
|---|---|
| 1 | 116 |
| 2 | 62 |
| 3 | 100 |
| 4 | 169 |
| 5 | 133 |
| 6 | 150 |

What is claimed is:

1. A composition comprising a solution of 3-(2-hydroxy-3-((2-propylheptyl)oxy)propoxy)propane-1,2-diol, glycol ether, an alkanolamine and sodium hydroxide.

2. A method of cleaning a hard surface, the method comprising contacting the surface with a cleaning composition comprising the composition of claim 1.

* * * * *